US009945195B2

(12) United States Patent
Jost et al.

(10) Patent No.: US 9,945,195 B2
(45) Date of Patent: Apr. 17, 2018

(54) METHOD FOR CONNECTING A DRILL HEAD TO A DRILL PIPE, AND DEVICE FOR HOLDING A DRILL HEAD

(71) Applicants: Frank Jost, Cologne (DE); Christian Funke, Leipzig (DE)

(72) Inventors: Frank Jost, Cologne (DE); Christian Funke, Leipzig (DE)

( * ) Notice: Subject to any disclaimer, the term of this patent is extended or adjusted under 35 U.S.C. 154(b) by 422 days.

(21) Appl. No.: 14/429,024

(22) PCT Filed: Sep. 19, 2013

(86) PCT No.: PCT/EP2013/069515
§ 371 (c)(1),
(2) Date: Mar. 18, 2015

(87) PCT Pub. No.: WO2014/044774
PCT Pub. Date: Mar. 27, 2014

(65) Prior Publication Data

US 2015/0218897 A1 Aug. 6, 2015

(30) Foreign Application Priority Data

Sep. 20, 2012 (DE) ..... 10 2012 216 917

(51) Int. Cl.
*E21B 19/18* (2006.01)
*E21B 17/04* (2006.01)
*E21B 17/042* (2006.01)

(52) U.S. Cl.
CPC ..... *E21B 19/18* (2013.01); *E21B 17/04* (2013.01); *E21B 17/042* (2013.01)

(58) Field of Classification Search
None
See application file for complete search history.

(56) References Cited

U.S. PATENT DOCUMENTS 2,000,221 A * 5/1935 Dawson ..... E21B 19/167 29/240
3,977,480 A 8/1976 Hilding
4,326,435 A * 4/1982 Guillot ..... E21B 19/164 81/57.16

(Continued)

FOREIGN PATENT DOCUMENTS

DE 10 2011 052 695 A1 2/2013
WO WO 2013/023972 A2 2/2013

OTHER PUBLICATIONS

Drawing provided by third party to Applicant prior to Sep. 2011.

*Primary Examiner* — Shane Bomar
(74) *Attorney, Agent, or Firm* — Muirhead and Saturnelli, LLC

(57) ABSTRACT

Producing a screw connection between a drill head provided for ground boreholes and an element of a drill pipe includes using a device for holding the drill head provided for ground boreholes. The device is held by a first clamping device of a clamping-screwing device. The element to be connected to the drill head is held by a second clamping device of the clamping-screwing-device and the element of the drill pipe to be connected is moved by the clamping-screwing device in relation to the device such that the relative rotation movement between the drill head and the element of the drill pipe required for the desired screw connection is performed by the clamping-screwing device.

13 Claims, 6 Drawing Sheets

(56) References Cited

U.S. PATENT DOCUMENTS

| | | | | |
|---|---|---|---|---|
| 4,974,686 | A | 12/1990 | Hisey et al. | |
| 6,311,789 | B1 | 11/2001 | Saxman | |
| 7,062,991 | B1 | 6/2006 | West et al. | |
| D741,926 | S * | 10/2015 | Matthews | E21B 19/18 D15/140 |
| 2002/0062717 | A1 | 5/2002 | Stogner | |
| 2006/0054331 | A1 | 3/2006 | Hawkins | |
| 2012/0234601 | A1* | 9/2012 | Griffin | E21B 19/18 175/57 |

* cited by examiner

METHOD FOR CONNECTING A DRILL HEAD TO A DRILL PIPE, AND DEVICE FOR HOLDING A DRILL HEAD

TECHNICAL FIELD

This application relates to connecting a drill head provided for ground boreholes (deep boreholes) to a drill pipe and to holding a drill head provided for ground boreholes in a force-fitting and/or form-fitting manner.

BACKGROUND OF THE INVENTION

The term deep boreholes refers in particular to petroleum, natural gas, or geothermal drilling, but also to other boreholes in which drill heads (also known as drill bits, roller bits, PDC bits, and/or any other bits of any geometry or shape) having a threaded fitting and which are capable of being screwed to another pipe element are employed. In many cases, after being screwed to the drill head, the pipe element screwed to the drill head is screwed at its opposite end to a further pipe element which is usually of identical design. This operation is then repeated multiple times in order to form a long drill string composed of a multiplicity of pipe elements, having a drill head at the lower end. The elements described above as "pipe elements" henceforth will be referred to as "elements of the drill string". These elements need not necessarily be "pipes" in the conventional sense. Instead of "pipes" any other elongate elements which are suited to a drill string may also be used. These substantially include rotationally symmetrical bodies which are interconnectable in the longitudinal direction. Pipe lengths may be between 9 meters and 13.5 meters.

The method which is carried out using a drill string as described above is also referred to as a "rotary method". A drill string henceforth is also referred to as a "drill pipe".

A few construction details pertaining to the described (pipe) elements of the drill string and to the assembly and disassembly of these elements of the drill string are described in patent application DE 10 2011 052 695. Reference is hereby made to the contents of this patent application. They form a composite part of this disclosure.

For many years, the interconnection of the elements of the drill string has been performed with the aid of clamping-screwing devices in so-called drill rigs. The term clamping-screwing devices in particular refers to the devices which in the technical terminology are referred to as "iron roughnecks" or as "hydraulic roughnecks". A known "iron roughneck" in the context of the system described herein usually comprises a high-speed rotating device (most often configured as a friction gear) which is referred to as a "spinner" and which usually engages in the lower region of the elements of the drill string and rapidly drives the latter which is suspended in a drill rig, in order to perform a first part of a screwing operation. This "iron roughneck" furthermore comprises a first clamping device for holding a first end of an element of a drill string in a clamping manner, as well as a second clamping device for holding a second end of an element of a drill string in a clamping manner. The first clamping device and the second clamping device, which are also referred to as "tongs" are mounted so as to be rotatable or pivotable, respectively, and are in particular employed for the second part of a screwing operation, in order to tighten the elements of the drill string which have already been screwed together with the aid of the "spinner", using a specific, predetermined torque. Therefore, using the "tongs", particular accuracy and thus high reliability of the screw joints are achieved.

The screw joint of the drill head with the lowermost element of a drill string to date mostly takes place with the aid of very large tongs which are usually referred to as "manual tongs" and are operated using muscle power or with the aid of hydraulic or, optionally, electric drives. In a complementary manner to the "manual tongs", so-called "bit crushing plates" are also employed. It is disadvantageous in the methods employed to date for connecting a drill head to an element of a drill string that said methods are very personnel and time intensive.

Further details pertaining to the clamping-screwing devices known from the prior art are disclosed in U.S. Pat. No. 7,062,991 B1 and from US 2002/0062717 A1.

U.S. Pat. No. 7,062,991 B1 particularly refers to the use of a plate which is mounted in lateral guide rails of a clamping-screwing device and which is employed in the context of the crushing plates mentioned above.

US 2002/0062717 A1 likewise refers to crushing plates, wherein the crushing plates are provided with anti-twist rods referred to as "torque transfer arms" which, together with receiving openings which are configured on the clamping-screwing device described in the document, are usable as momentum support for the crushing plates once the latter have been moved into one another.

Accordingly, it is desirable to provide a method as well as a device for holding a drill head provided for ground boreholes in a force-fitting or form-fitting manner, which both simplify connecting a drill head to an element of a drill pipe.

SUMMARY OF THE INVENTION

Producing a screw connection between a drill head provided for ground boreholes and a drill pipe includes the following:

a) positioning an element of a drill pipe to be connected to the drill head above the drill head,
b) moving the element to be connected in a controlled manner in the direction of a thread connected with the drill head into a position in which by rotating the element, the drill pipe, and/or the drill head a screw connection between the element to be connected and the drill head is producible,
c) rotating the element to be connected and/or the drill head in order to produce the screw connection, wherein
d) the drill head, prior to producing the screw connection, is connected in a form-fitting manner by way of a gripping portion disposed above a drill structure to a device for holding a drill head provided for ground boreholes,
e) the device is held by a first clamping device of an automatic clamping-screwing device,
f) the element to be connected to the drill head is held by a second clamping device of the mentioned clamping-screwing-device, and
g) the element of the drill pipe to be connected is moved by the automatic clamping-screwing device in relation to the device such that the relative rotation movement between the drill head and the element of the drill pipe required for the desired screw connection is performed by the clamping-screwing device.

A device for holding a drill head provided for ground boreholes in a form-fitting manner, includes the following elements:

a) a claw-shaped holding structure for at least partially encompassing a gripping portion which is configured above a drill head, and b) a housing having a circular or polygonal outer contour for holding in a clamping manner with a clamping-screwing device, wherein the housing is connected or connectable to the holding structure in a rotationally fixed manner.

A holding structure may have mutually opposed faces which are disposed or disposable so as to be parallel with one another in order to be laterally pushed onto the gripping portion. Alternatively, the holding structure may also have another shape if the latter is suited to the drill head being held from the outside by a grip of the holding structure. At this point, reference is made in only an exemplary manner to a polygon-type configuration.

The gripping portion preferably adjoins a projecting bearing portion. The use of a device according to the system described herein enables the use of clamping-screwing devices known from the prior art, which for a plurality of decades have exclusively been employed for screwing together two elements of a drill pipe, for screwing a drill head to an element of a drill pipe. Further details relating thereto are discussed. The use of a clamping-screwing device for connecting a drill head to an element of a drill pipe enables a more rapid, more precise, and more cost-effective connection than the known connection of drill heads to elements of drill pipes by means of the "manual tongs" described at the outset or other known aids, respectively. Furthermore, the system described herein follows the "hands off" principle and reduces the risk of work-related accidents during a screwing operation.

In one particular embodiment of the device according to the system described herein, the housing has at least an external dimension which is larger than the largest external dimension of the pipe structure of the drill head to be connected. In this embodiment the housing may be designed as an encircling housing protecting the drill head including the latter's drill structure. In this case, the drill head together with the device according to the system described herein may be pre-assembled and be mounted and moved suspended therein.

In one practical embodiment of the method according to the invention the relative movement between the element of the drill pipe to be connected and the device takes place in at least the following sequences:

a) rotating the element of the drill pipe in relation to the device at a first speed, until a first torque limit value (low) has been reached, b) further rotating the element of the drill pipe in relation to the device at a second speed, until a second torque limit value has been reached.

Here, method step a) preferably takes place with the aid of a high-speed rotating device, in particular a "spinner" of an "iron roughneck", which is known in practice. Such a "spinner", when viewed in the longitudinal direction, usually engages in the lower region of the element to be connected, but may also be displaced in the longitudinal direction and engage on other vacant points of an element. In the case of most "iron roughnecks" the "spinner" is an integral component part of the device. However, a separate "spinner" may also be employed.

In a further practical embodiment further rotating according to the preceding method step b) mentioned takes place at a second speed with the aid of the first clamping device and/or the second clamping device. With reference to known "iron roughnecks" the first clamping device and the second clamping device in the sense of the system described herein are two very large tongs with the aid of which very large elements may be securely clamped and tightened with an adjustable torque.

When described in a simple manner, connecting a drill head using a device according to the system described herein preferably is initially performed by screwing with the aid of a "spinner", using a first low torque, and subsequently by screwing with the aid of the described first clamping device and the second clamping device, using a second higher torque which is precisely adjustable. The difference between the two torques preferably is selected such that the clamping devices only have to be moved by less than 90°, preferably less than 45°, and particularly preferably by less than 30° in relation to one another. Since the first clamping device and the second clamping device, above all, serve for applying a precise torque, the angle required for achieving the desired torque preferably is selected so as to be as small as possible, for example such that it is between 1° and 10°, or between 1° and 20°, respectively.

The holding structure and the housing of a device according to the system described herein may be integrally configured. In this case, the device is simple to manufacture and robust.

According to one other practical embodiment of the device according to the system described herein the holding structure is a component part of a first part-element, and the housing is configured as a separate, second part-element. On account thereof, particularly simple and intuitive handling of the device results.

More detailed reference with respect to handling devices which are configured in one part or a plurality of parts will be made in the description of the figures.

In one further practical embodiment of the device according to the system described herein the geometry of the holding structure and the geometry of the housing are adapted to one another such that the holding structure is positionable in a rotationally fixed manner in the housing. In particular, this takes place by an entirely complementary configuration of holding structure and housing or by a configuration of a specific contour (the outer contour, for example) on one of the elements and an at least partially complementary clearance on the other element. Furthermore, any other anti-twist device known from the prior art may be provided for the rotationally fixed arrangement of the holding structure in the housing, for example a locking mechanism.

If at least one securing element is disposed or disposable on the holding structure and/or on the housing in such a manner that the drill head after having been inserted into the claw-shaped holding structure, and after the securing element has been locked, is fixated in a form-fitting manner in the device, the reliability of the device can be further improved. Namely in this case it is effectively prevented that the connection between the holding structure and the drill head, once established, is inadvertently released, for example during shipping or any other moving of the assembly. It is in particular prevented that a person, with or without the aid of a lifting device, grips the holding structure with the inserted drill head and subsequently by rotating or pivoting moves the same into a position in which the connection could be inadvertently released.

The housing of a device according to the system described herein preferably is configured so as to be tubular, that is to say that it includes at least part-portions of a cylinder or a cylinder barrel. One advantage of such a design is the arbitrary relative arrangement of the housing with the aid of a clamping device. Furthermore, devices of this type from a tubular standard construction element can be manufactured in a comparatively cost-effective manner.

The holding structure of a device according to the system described herein preferably is configured so as to be U-shaped. This geometric design is not only manufacturable in a cost-effective manner, but is also very good for handling together with a drill head. Handling will be discussed in more detail in the description of the figures.

In one further practical embodiment of the device according to the system described herein, said device is composed of at least two part-elements which preferably can be joined together in order to form a device having a circular or polygonal outer contour. Such part-elements may have a semi-circular basic shape, for example. Preferably, they are readily interconnectable in a releasable manner. Connecting the part-elements may take place by means of bolts, by means of at least one tension strap, at least one Seeger circlip ring, at least one cable tie, and/or by means of at least one clamp. So-called quick-release clamps as well as fulcrum-pin clamps are particularly suitable as clamps. If clamps, Seeger circlip rings, cable ties, or tension straps are used it is furthermore advantageous for an encircling depression and/or other elements for guiding or receiving, respectively, the clamp, the Seeger circlip ring, the cable tie, and/or the tension strap to be provided on the outer side of the part-elements.

BRIEF DESCRIPTION OF THE DRAWINGS

Further practical embodiments and advantages are described in the following in the context of the drawings, in which.

DETAILED DESCRIPTION OF VARIOUS EMBODIMENTS

Figure 2:
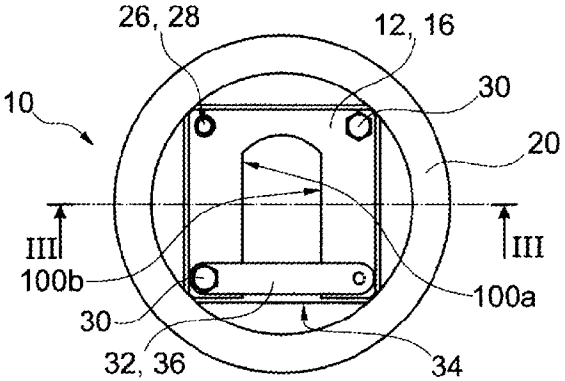
FIG. 2 shows the device according to the system shown in FIG. 1, in a plan view.
Figure 3:
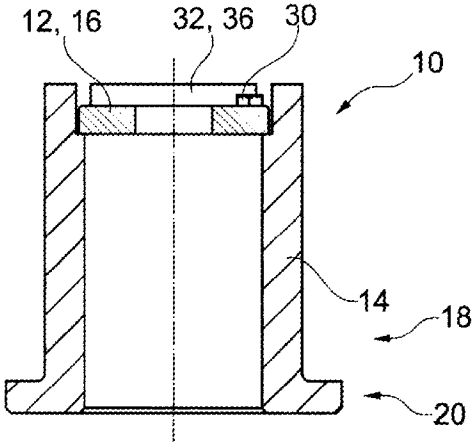
FIG. 3 shows the device shown in FIGS. 1 and 2, in a sectional illustration according to the arrows III-III in FIG. 2.
Figure 1:
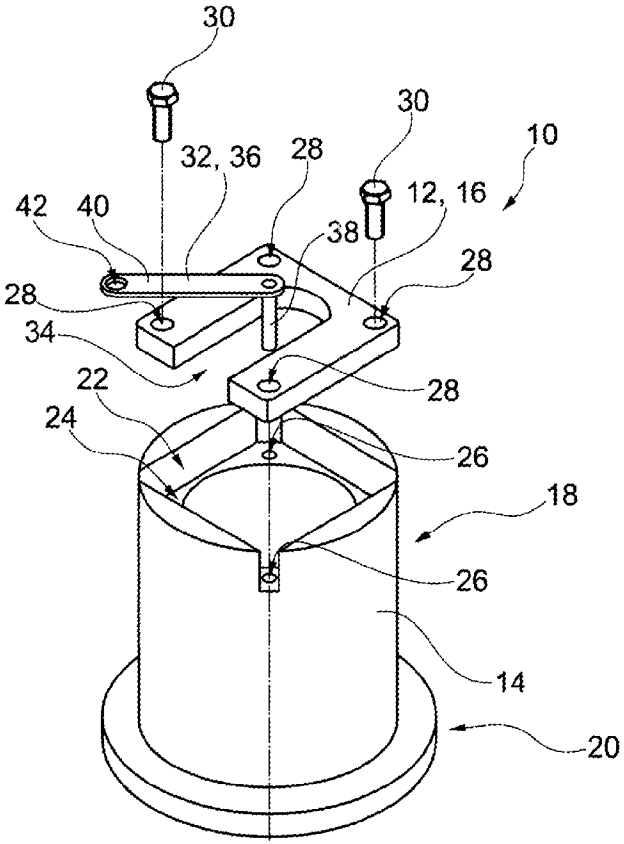
FIG. 1 shows a first embodiment of a device, in an exploded illustration according to an embodiment of the system described herein.

FIGS. 1-3 show various views of a first embodiment of a device 10 according to the system described herein, which is substantially composed of a claw-type holding structure 12, which is configured so as to be U-shaped, and a housing 14 which is configured so as to be of a sleeve-type. The claw-type holding structure 12 of the first embodiment is composed of a square plate which henceforth is also referred to as locking plate 16. The housing 14 comprises a cylindrical portion 18 and a laterally projecting flange 20 adjoining thereto on the lower side. On the upper side, the housing 14 includes a square clearance 22 which enables the locking plate 16 to be inserted, as is shown in FIGS. 2 and 3. In the inserted state, the locking plate 16 bears on an abutment face 24 which has a circular inner contour and a substantially square outer contour and which is configured in the region of the clearance 22. Threaded bores 26 are configured in the corner regions of the abutment face 24. On account thereof, the locking plate 16 can be screwed to the housing 14 with the aid of screws 30.

The locking plate 16, in its corner regions, includes through openings 28 which, when the locking plate 16 is inserted into the clearance 22 and bears on the abutment face 24, are in alignment with the threaded bores 26 in the housing 14.

A safety catch 36 having a cylindrical shaft 38 and an elongate catch 40 is provided as a securing element 32 for closing the opening 34 of the claw-type holding structure 12 in the first embodiment of the device 10 according to the system described herein, illustrated in FIGS. 1-3. Furthermore, a through opening 42 is configured on the catch 40. As shown in FIG. 2, the securing element 32 is designed such that the catch 40 can be screwed to the locking plate 16 by way of a screw 30, when the catch 40 is located in a position which closes the opening 34.

Figure 4:
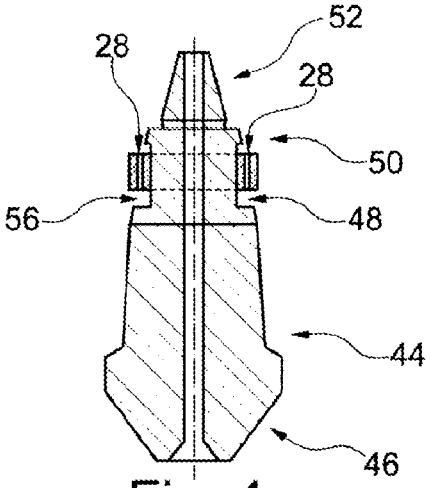
FIG. 4 shows a drill head known from the prior art, having a claw-shaped holding structure pushed thereonto, in a side view.
Figure 5:
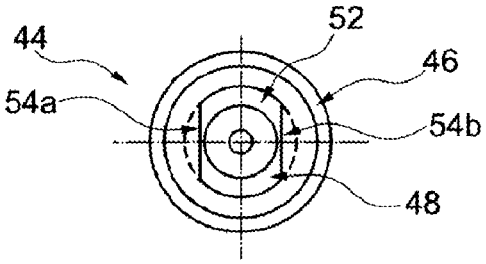
FIG. 5 shows the drill head shown in FIG. 4, without the holding structure, in a plan view.

In an exemplary manner, that is to say in a schematic and highly simplistic manner, FIGS. 4 and 5 show a drill head 44 known from the prior art, having a drill structure 46 configured on the lower end thereof, a gripping portion 48 disposed thereabove, a bearing portion 50 which is disposed above the gripping portion 48, and a conical portion 52 which adjoins above the bearing portion 50 and which has an external thread (not shown). The locking plate 16 should be individually adapted so as to be specific (for example thickness, width of the opening 34, etc.) to a drill bit (various manufacturers).

Figure 6:
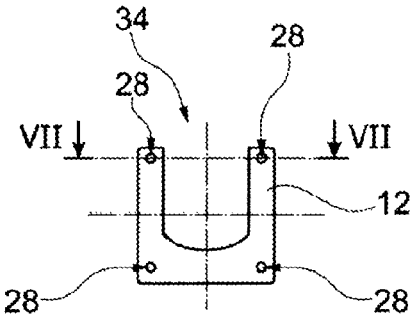
FIG. 6 shows the claw-shaped holding structure in a plan view.
Figure 7:
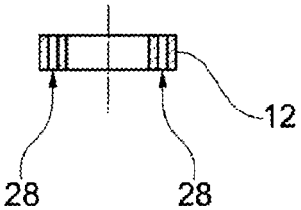
FIG. 7 shows the holding structure shown in FIG. 6, in a sectional view according to the arrows VII-VII in FIG. 6.

The bearing portion 50 has not been illustrated in FIG. 5, in order for the gripping portion 48 to be visible. As can be identified in FIG. 5 the gripping portion 48 includes two mutually opposed faces 54*a*, 54*b*, which are disposed so as to be parallel with one another and which enable the U-shaped holding structure 12 illustrated in FIGS. 6 and 7, which corresponds to the holding structure 12 illustrated in FIGS. 1-3, to be laterally pushed onto the gripping portion 48 of the drill head 44. The holding structure 12 is illustrated in a simplified manner, that is to say in particular without a securing element, in FIGS. 6 and 7 as well as in FIG. 4. The holding structure 12 is designed such that a drill head 44 which is inserted as illustrated in FIG. 4 into the opening 34 of the holding structure 12 is limited in its freedom of movement upwardly by the laterally protruding collar of the bearing portion 50 and downwardly by the laterally protruding shoulder 56. Closing the securing element 32 prevents the connection between the holding structure 12 being released by way of sliding out laterally through the opening 34.

Figure 8:
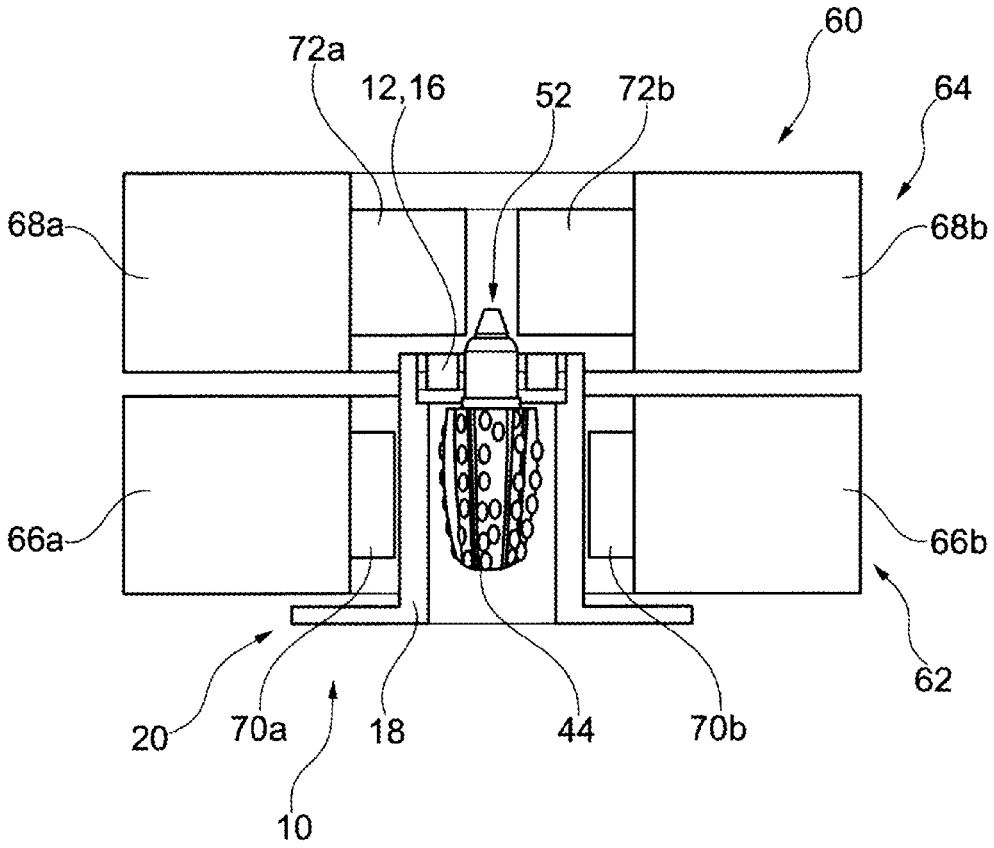
FIG. 8 shows the device, shown in FIGS. 1-3, having a pre-assembled drill head in a known clamping-screwing device (iron roughneck)

By means of FIGS. 8 and 9 it will be described in the following how the first embodiment of the device 10 according to the system described herein may be employed in order to establish a screw joint between a drill head 44 and an element 58 of a drill pipe with the aid of a known clamping-screwing device 60.

First, the drill head 44, together with the device 10 according to the system described herein, is pre-assembled. To this end, the locking plate 16 is pushed onto the gripping portion from the side, as illustrated in FIG. 4. Then, the locking plate 16, together with the drill head 44, is inserted from above into the housing 14 such that the locking plate 16 bears on the abutment face 24 of the housing 14. By pivoting the securing element 32 into the position shown in FIG. 2 and screwing the securing element 32 to the housing 14, it is subsequently ensured by way of a form fit that the drill head 44 can no longer be removed from the pre-assembled unit. As shown in FIG. 8 this pre-assembled unit composed of the housing 14, the claw-shaped holding structure 12, and the drill head 44 is inserted into a clamping-screwing device 60 known from the prior art in the following step.

The clamping-screwing device 60 comprises a first clamping device 62 and a second clamping device 64 which are disposed so as to be on top of one another. Each of the clamping devices 62, 64 is in each case composed of two outer clamping jaws 66*a*, 66*b*, and 68*a*, 68*b*, respectively, and of inner clamping jaws 70*a*, 70*b*, and 72*a*, 72*b*, respectively, which are designed so as to be connectable to the former. The inner clamping jaws 70*a*, 70*b*, 72*a*, 72*b*, in their dimensions are adapted to the items to be clamped and usually configured as replaceable wear parts having a high coefficient of friction. The first clamping device 62 and the second clamping device 64 may be moved in relation to one another such that elements held in the clamping devices 62, 64, can be rotated in relation to one another. This may also be performed using a pre-defined torque. To this extent, this property can be employed for screwing together two elements, using a desired torque. It is additionally pointed out that clamping-screwing devices having three or more clamping jaws may also be used instead of the illustrated clamping-screwing device 60 having in each case two clamping jaws 70*a*, 70*b*, and 72*a*, 72*b*, respectively.

Figure 9:
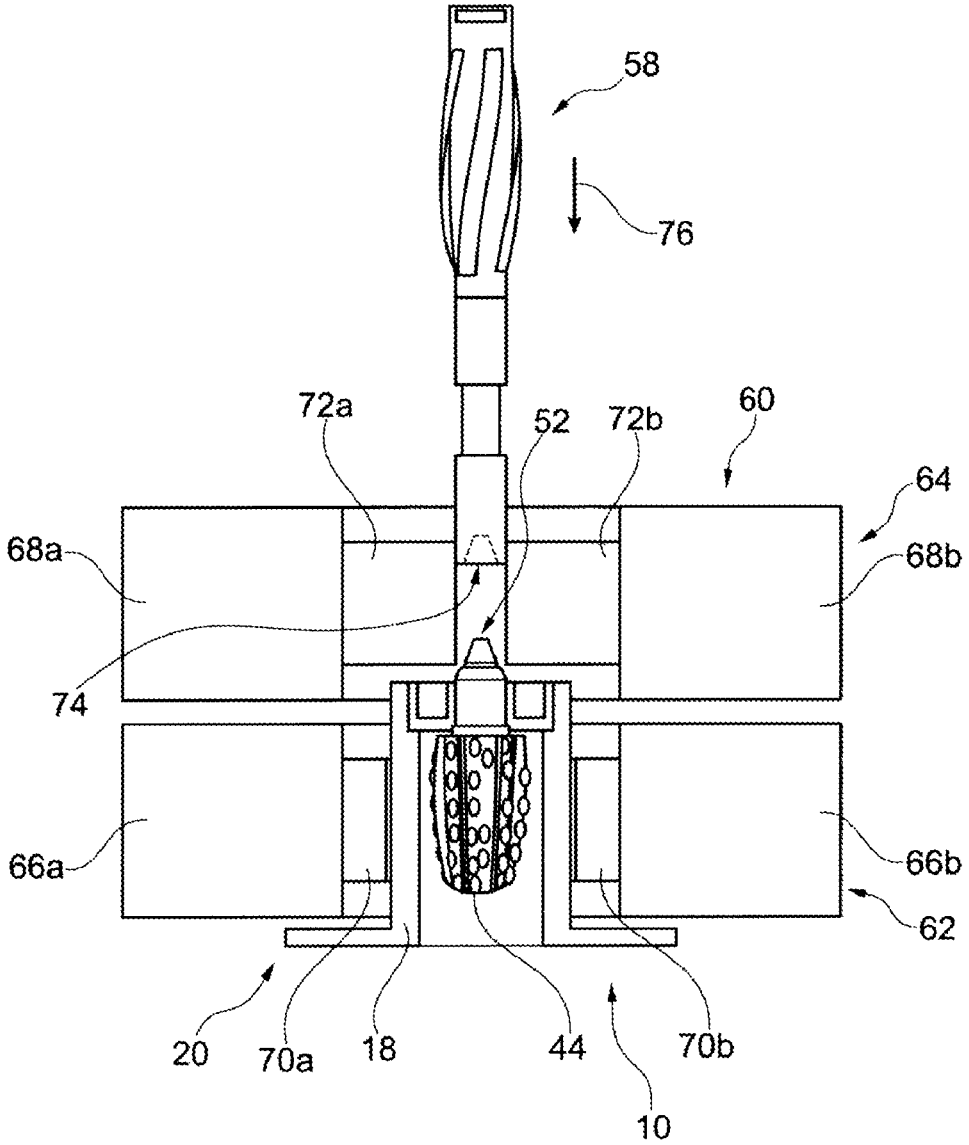
FIG. 9 shows the device shown in FIG. 8, immediately prior to connecting the drill head to an element of a drill pipe.

It is illustrated in FIG. 9 how an element 58 of a drill pipe is inserted from above into the clamping-screwing device 60. The first clamping device 62 is closed and securely holds the housing 14 in the shown position. The element 58, on its lower side, includes a clearance 74 having an internal thread which is configured so as to be complementary to the conical portion 52 of the drill head 44. The element 58 is lowered so far in the direction of the arrow 76 until it can be screwed to the drill head 44 by way of rotation. To this end, the element 58 is initially gripped in the central region of a high-speed rotation device (also called a "spinner") (not shown) and rotated until a first torque value has been reached. The high-speed rotation device is subsequently opened. Now, the second clamping device 64 is closed and securely clamps the element 58 in the lower region. The first clamping device 62 and the second clamping device 64 are now moved in relation to one another, in order to screw the element 58 to the drill head 44, using a pre-defined torque.

The method described above may also be performed in an analogous manner using other embodiments of devices according to the system described herein. In the following, reference is made to two further embodiments which are illustrated in FIGS. 10 to 13. The same reference signs are used in the following for identical elements or elements with identical functions.

Figure 10:
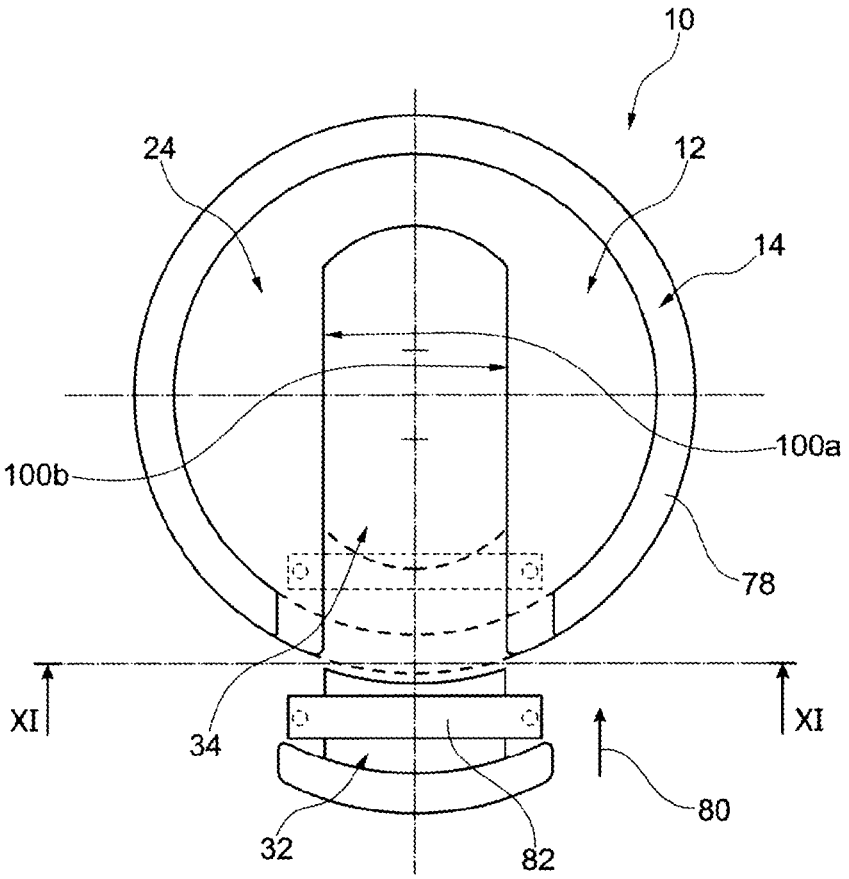
FIG. 10 shows a second embodiment of a device according to the system described herein, in a plan view.
Figure 11:
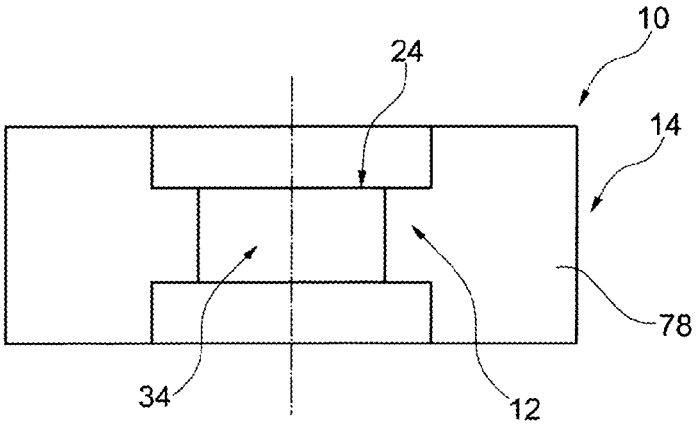
FIG. 11 shows the device illustrated in FIG. 10, in a view from the front.

FIGS. 10 and 11 show a second embodiment of a device 10 according to the system described herein. In the case of this device the housing 14 and the claw-type holding structure 12 are configured so as to be integral. The device substantially is composed of a cylindrical structure having an outer ring 78 which is open to one side and an abutment face 24 which is encased by the outer ring 78. The abutment face 24 includes a substantially U-shaped clearance 22 into which a drill head (not shown in FIG. 10) can be pushed in such a manner as has been described above in the context of the first embodiment. After having pushed the drill head into the clearance 22 of the claw-type structure 12, a separate securing element 32 can be pushed on in the direction of the arrow 80. In the shown embodiment the securing element 32 is composed of an element which complements the outer ring 78 and the abutment face 24 to form elements having a circular contour, as shown in dashed lines in FIG. 10. An abutment tongue 82 which is fixedly connected to the securing element 32 is located on the upper side of the securing element 32. By way of circular openings 84 which are indicated by dashed lines, corresponding openings in the abutment face 24, and bolts which are not illustrated (or other connecting elements), for example, said abutment tongue 82 may be utilized for establishing a reliable connection between the securing element 32 and the holding structure 12 or the housing 14, respectively, and to thus prevent that a drill head (not illustrated in FIG. 10) inserted into the opening 30 of the claw-type holding structure 12 is inadvertently released from the opening 34 of the device 10 according to the invention. By way of inserting the securing element 32 an annular fit which considerably increases the overall stability of the device 10 shown in FIG. 10 for further use results.

Figure 12:
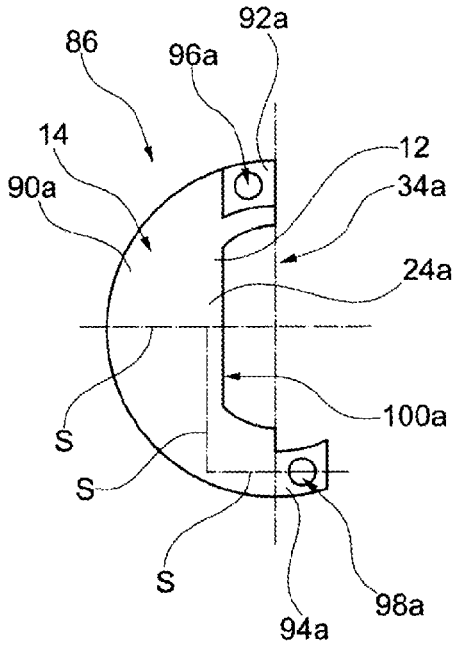
FIG. 12 shows a first part-element of a third embodiment of a device according to the system described herein, in a plan view.
Figure 13:
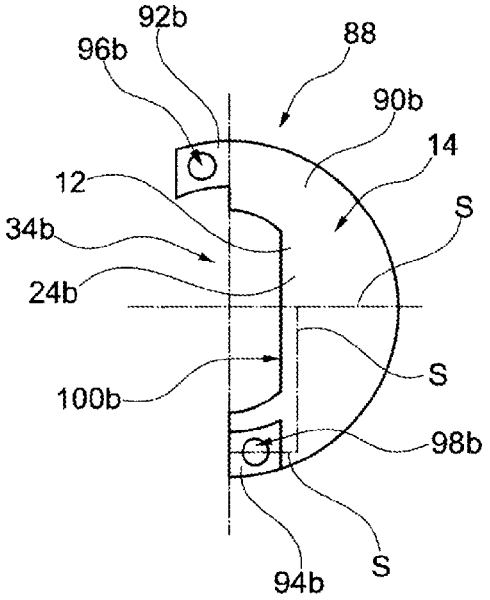
FIG. 13 shows a second part-element of a third embodiment of a device according to the system described herein, in a plan view.
Figure 14:
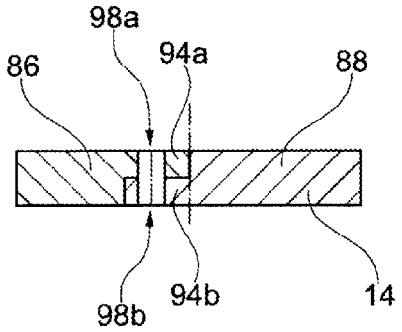
FIG. 14 shows a sectional illustration, according to the line S in FIGS. 12 and 13, through the virtually joined together part-elements in FIGS. 12 and 13.

FIGS. 12 and 13 in each case show one plan view of a third embodiment of a device 10 according to the system described herein. In the third embodiment the device 10 according to the system described herein is subdivided into a first part-element 86 and a second part-element 88, FIG. 12 showing the first part-element 86, and FIG. 13 showing the second part-element 88. In the case of this embodiment, the first part-element 86 and the second part-element 88 with their outer sides collectively form a housing 14. The inner sides of the first part-element 86 and of the second part-element 88 collectively form a claw-type holding structure 12 in two parts, by means of which drill structures 46 known from the prior art can be held by their gripping portion 48, as is described in particular in the context of FIGS. 4-5 using the example of the first other embodiment of a device according to the invention. Each part-element 86, 88, substantially is composed of a semi-circular segment 90*a*, 90*b*, having in each case one opening 34*a*, 34*b*, on the straight side, and tongues 92*a*, 94*a*, 92*b*, 94*b*. Openings 96*a*, 98*a*, 96*b*, 98*b*, are configured in the tongues 92*a*, 94*a*, 92*b*, 94*b*. In the regions of the tongues 92*a*, 94*a*, 92*b*, 94*b*, the part-elements 86, 88, are configured so as to be complementary, as is identifiable in FIG. 14, that is to say that the part-elements 86, 88, configured in FIGS. 12 and 13, by being pushed onto one another complement one another in order form a device 10 having a circular outer contour and a clearance in the central region, which in its shape corresponds to the clearance of the device having an inserted securing element 32, as illustrated in FIG. 10. In the joined together state of the part-elements 86, 88, the openings 96*a*, 96*b*, and 94*a*, 94*b*, respectively, are in alignment with one another. The part-elements 86, 88, then can be interconnected and released again from one another by simply introducing a bolt which is shaped so as to be slightly conical.

The part-elements 86, 88, may also be designed such that a bolt permanently interconnects the part-elements 86, 88, and the part-elements, for enclosing a gripping portion 48 of a drill head 44, are pivoted about this bolt. In this case, the geometry in the region of the tongues 92*a*, 94*a*, 92*b*, 94*b*, has to be correspondingly adapted, that is to say that radii have to be provided so that the parts are pivotable about the bolt which is permanently pushed thereinto.

Instead of the clearance in the described devices according to the system described herein, which has been adapted to the geometry of a gripping portion of a known type of drill head, other geometries which are suited to hold the drill head to be received for connection to an element of a drill pipe may also be configured.

Connection of the part-elements 86, 88, may also be performed with the aid of other suitable elements, for example with the aid of screw bolts.

Even though only form-fitting connections are shown in the figures, it is stressed yet again at this point that force-fitting connections between a device according to the system described herein and a drill head are within the scope of the invention. Therefore, instead of an opening having a defined width (with or without an additional securing element), a clamping device on the inner side of a device according to the system described herein may also be provided. Such a clamping device has the advantage that gripping portions with various dimensions can be received therewith. In contrast thereto, the described form-fitting embodiments have the advantage that they can be manufactured in a simple and cost-effective manner and meet high requirements in terms of safety.

In comparison with the first embodiment, the embodiments described in FIGS. 10 to 14 have the advantage that the drill structure may be larger, since it is not enclosed by the housing.

The first and second embodiment of the device 10 according to the system described herein include mutually opposite faces 100*a*, 100*b*, which are disposed so as to be parallel with one another. The third embodiment includes two faces 100*a*, 100*b*, which are disposable so as to be parallel with one another and mutually opposite. To this end, the part-elements 86, 88, have to be interconnected as described above. The third embodiment, having faces 100*a*, 100*b*, which are disposable so as to be parallel with one another has the advantage that it may completely disassembled and thus does not have to be laterally pushed on. Assembly is thus more flexible. By providing further assembly possibilities or the combination with other elements of similar design, there is also the possibility for this embodiment to be designed so as to be variable in such a manner that the device is usable for drill structures having gripping portions of various dimensions.

All features disclosed in the present description, in the drawings, as well as in the claims, may be individually as well as in any arbitrary combinations substantial to the implementation in various embodiments. The invention is also not limited to the embodiments described above. The invention may be varied within the scope of the claims and considering the knowledge of a person skilled in the art. In this context it is to be noted, in particular, that instead of two part-elements, as described in the description of the figures, a device according to the system described herein may be composed of three, four, five, or more part-elements.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

The invention claimed is:

1. A method for producing a screw connection between a drill head provided for ground boreholes and an element of a drill pipe, the method comprising:

positioning an element of a drill pipe to be connected to the drill head above the drill head;

moving the element to be connected in a controlled manner in the direction of a thread connected with the drill head into a position in which by rotating the element, the drill pipe, and/or the drill head a screw connection between the element to be connected and the drill head is producible;

rotating the element to be connected and/or the drill head in order to produce the screw connection; and prior to producing the screw connection, connecting the drill head in a form-fitting manner by way of a gripping portion disposed above a drill structure to a device for holding a drill head provided for ground boreholes, wherein the device is held by a first clamping device of a clamping-screwing device the element to be connected to the drill head is held by a second clamping device of the clamping-screwing-device and the element of the drill pipe to be connected is moved by the clamping-screwing device in relation to the device such that the relative rotation movement between the drill head and the element of the drill pipe required for the desired screw connection is performed by the clamping-screwing device.

2. The method as claimed in claim 1, wherein the relative movement between the element of the drill pipe to be connected and the device takes place in a following sequence:

rotating the element of the drill pipe in relation to the device at a first speed, until a first torque limit value has been reached, and further rotating the element of the drill pipe in relation to the device at a second speed, until a second torque limit value has been reached.

3. The method as claimed in claim 2, wherein rotating at the first speed takes place with aid of a high-speed rotating device which engages in the central region of the element to be connected.

4. The method as claimed in claim 2, wherein further rotating at a second speed takes place with aid of the first clamping device and/or the second clamping device.

5. A device for holding a drill head provided for ground boreholes in a form-fitting manner, comprising:

a claw-shaped holding structure for at least partially encompassing a gripping portion which is configured above a drill head; and a housing having a circular or polygonal outer contour for holding in a clamping manner with a clamping-screwing device, which is connected or connectable to the holding structure in a rotationally fixed manner, wherein the clamping-screwing device is an iron roughneck composed of at least two part-elements and wherein the at least two part-elements are two toroidal segments which are connectable to form a complete toroid.

6. The device as claimed in claim 5, wherein the holding structure is a component part of a first part-element, and the housing is configured as a separate, second part-element.

7. The device as claimed in claim 6, wherein the geometry of the holding structure and the geometry of the housing are adapted to one another such that the holding structure is positionable in a rotationally fixed manner in the housing.

8. The device as claimed in claim 5, wherein a securing element is disposed or disposable on the holding structure and/or on the housing in such a manner that the drill head, after insertion into the claw-shaped holding structure and closing the securing element is fixated in a form-fitting manner in the device.

9. The device as claimed in claim 5, wherein the housing is configured so as to be tubular and/or the holding structure is configured so as to be U-shaped.

10. The device as claimed in claim 5, wherein the claw-shaped holding structure comprises two faces which are disposed or disposable so as to be parallel with one another.

11. The device as claimed in claim 5, wherein the housing and the claw-shaped holding structure are formed by at least two part-elements.

12. The device as claimed in claim 5, wherein the at least two part-elements are interconnected and/or interconnectable such that a structure for completely encompassing by way of two faces which are disposed so as to be parallel with one another results within the at least two part-elements.

13. The device as claimed in claim 5, wherein the at least two part-elements are connected and/or connectable by means of bolts, by means of at least one tension strap and/or by means of at least one clamp.

* * * * *